United States Patent [19]

Lakic et al.

[11] Patent Number: 4,736,530

[45] Date of Patent: Apr. 12, 1988

[54] SHOE WITH HEAT ENGINE AND REVERSIBLE HEAT ENGINE

[76] Inventors: Nikola Lakic, 73-355 Guadalupe Ave., Palm Desert, Calif. 92260; Ristic Vladislav, 5202 Victoria Pl., Westminster, Calif. 92683

[21] Appl. No.: 15,119

[22] Filed: Feb. 17, 1987

[51] Int. Cl.[4] ..... A43B 7/02; F28F 7/00

[52] U.S. Cl. ..... 36/2.6; 165/46; 128/382

[58] Field of Search ..... 36/2.6; 165/46; 128/382, 383, 402

[56] References Cited

U.S. PATENT DOCUMENTS

| | | | |
|---|---|---|---|
| 1,272,931 | 7/1918 | Etheridge | 36/2.6 |
| 2,442,026 | 5/1948 | Thompson, Jr. | 36/2.6 |
| 3,000,616 | 9/1961 | Spangler | 36/2.6 |
| 3,493,986 | 2/1970 | Erwin | 36/2.6 |
| 3,534,391 | 10/1970 | Bauer | 36/2.6 |
| 4,653,729 | 3/1987 | Ando | 165/46 |

FOREIGN PATENT DOCUMENTS

| | | | |
|---|---|---|---|
| 1223883 | 4/1986 | U.S.S.R. | 36/2.6 |

*Primary Examiner*—Werner H. Schroeder
*Assistant Examiner*—Steven N. Meyers
*Attorney, Agent, or Firm*—Plante, Strauss & Vanderburgh

[57] ABSTRACT

There is disclosed a shoe with an internal warming mechanism that includes a heat engine and, in particular, a heat engine operating on a substantially or quasi-Carnot cycle. The warming mechanism has a compressor for compressing a gas, a condenser for condensing the gas into a liquid, an expansion and evaporator zone for expanding the liquified gas into a gas and a return line to cycle the expanded gas to the compressor. The source of energy for compression of the gas is the movement of the wearer's foot in the shoe, and the heel of the shoe has a hollow cavity in which the gas compressor is located. The sole of the shoe has an internal heel plate which is coupled, on its undersurface, to a post which is mechanically linked to the gas compressor such that up and down movements of the post in response to the movement of the wearer's heel will drive the compressor and provide the necessary work to drive the heat engine.

14 Claims, 5 Drawing Sheets

SHOE WITH HEAT ENGINE AND REVERSIBLE HEAT ENGINE

BACKGROUND OF THE INVENTION

1. The Field of the Invention

This invention relates to a warming device for shoes and in particular to a simple device for generating heat within a shoe during normal walking and running.

2. Brief Statement of the Prior Art

U.S. Pat. No. 3,534,391 discloses an electrical generator which is mounted on the outside of a ski boot which is driven from a tether that is connected between the generator and a ski. The generated current is passed through heating elements located in the ski boot. The external mounting and tether render this device quite cumbersome and difficult to use.

French Patent Nos. 7091,420 and 2365-973, and U.S. Pat. Nos. 4,507,877 and 3,977,093 disclose shoes with batteries mounted in the heels, and with electric resistance heaters in the soles of the shoes. Batteries require frequent replacement, and are particularly inefficient in a cold environment.

U.S. Pat. No. 1,506,282 discloses an electric generator mounted in a telescoping heel of a shoe which generates electricity for an electric lamp, heating coil, wireless outfit or a therapeutic appliance. A telescoping heel of this design would be very difficult to seal against water and mud, and the patented device would most likly be limited to indoor applications.

U.S. Pat. Nos. 2,442,026 and 1,272,931 disclose air pumps which are located in the heels of shoes and operated during walking. In the first mentioned patent, alcohol vapors are mixed with the air stream and passed over a catalyst to generate heat. In the latter patent, the air is forced through constricted passageways to generate heat by compression.

U.S. Pat. No. 382,681 discloses an armature which is mounted in a heel and manually rotated to generate heat by friction, which is dissipated in the shoe by metal conductors. U.S. Pat. No. 3,493,986 discloses an inner sole for a shoe which is formed of piezoelectric or magnetostrictive material which generate heat while the user walks.

U.S. Pat. No. 2,475,093 discloses a bouncing skate having spring coils on the bottom of its sole. German Patent Nos. 180866 and 620,963, and U.K. Patent No. 443,571 disclose springs mounted within a shoe for orthopedic purposes.

All of the aforementioned attempts to provide a self sustaining heater within a shoe have failed to recognize that there is relative movement between the wearer's heel and the heel of the shoe, or to harness this relative movement to generate heat. This relative movement can be sufficient, particularly when the wearer's weight is applied, to generate the necessary heat, provided a practical heat generator can be installed within the narrow confines of the shoe and heel, without significantly affecting its external appearance and comfort.

RELATION TO OTHER APPLICATIONS

In my parent application, Ser. No. 849,024, filed Apr. 7, 1986, I have disclosed a foot warmer mechanism which is incorporated in a shoe. The device illustrated in my parent application utilizes electrical generators which are driven by the up and down movement of a person's foot within the shoe to generate an electrical current which is passed through an electrical resistance heater within the shoe. In my copending application, Ser. No. 877,503, I have also disclosed a foot warmer mechanism having a pair of inner soles which are rubbed together during walking to generate heat by frictional contact.

While the aforementioned mechanisms are effective in warming a shoe, a less complex mechanism is desired to reduce costs and improve reliability.

BRIEF STATEMENT OF THE INVENTION

This invention is a shoe with an internal warming mechanism that includes a heat engine and, in particular, a heat engine operating on a substantially or quasi-Carnot cycle. For this purpose, the warming mechanism includes a compressor for compressing a gas, a condenser for condensing the gas into a liquid, an expansion and evaporator zone for expanding the liquified gas into a gas and a return line to cycle the expanded gas to the compressor. The source of energy for compression of the gas is the movement of the wearer's foot in the shoe. For this purpose, the heel of the shoe has a hollow cavity in which the gas compressor is located. The sole of the shoe has an internal heel plate which is coupled, on its undersurface, to a post which is mechanically linked to the gas compressor such that up and down movements of the post in response to the movement of the wearer's heel will drive the compressor and provide the necessary input work to the heat engine.

DESCRIPTION OF THE DRAWINGS

The invention will be described with reference to the figures of which.

DESCRIPTION OF THE PREFERRED EMBODIMENT

Figure 1:
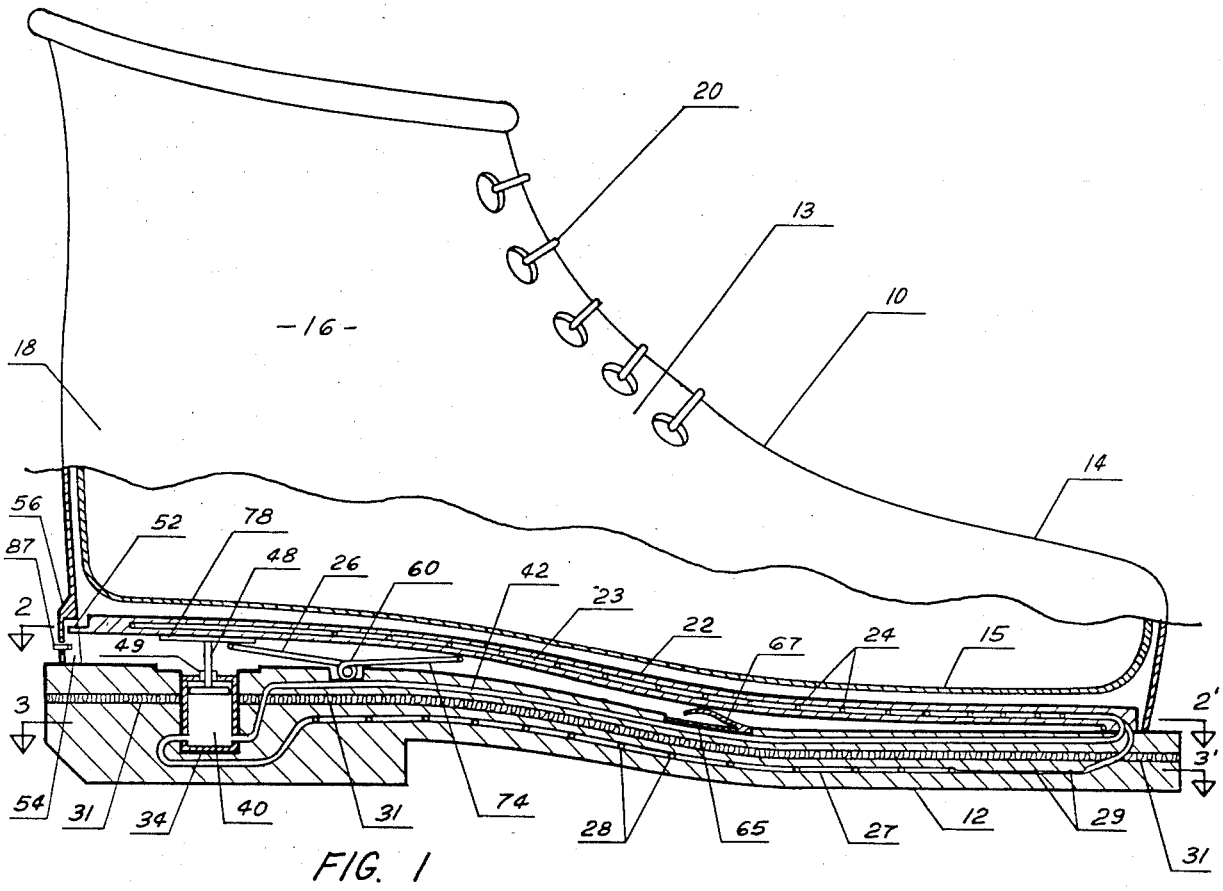
FIG. 1 is an elevational view, partially in cross section, of the shoe of the invention.

The invention will be described with reference to FIG. 1 which illustrates a shoe that includes the foot warmer mechanism of the invention. The shoe is illustrated in partial cross-section. Externally, the shoe of the invention does not differ significantly from a conventional shoe. The shoe 10 has a sole 12 which is formed in subassembly to an upper portion 13 with conventional assembly techniques, e.g., sewing, gluing, etc. The upper portion 13 includes a toe cover portion 14, side panels such as 16, and preferably an anklet portion 18, all of which are secured together with conventional lacing 20, or other conventional fasteners, such as zippers, snap fasteners, etc. Preferably, a liner 15 of soft leather or fabric is fitted within the shoe to protect the wearer's foot against abrasion and frictional contact with the shoe. If desired, the liner could be perforated. The specific application illustrated is with reference to a ski boot, however the invention is equally applicable to any other foot apparel.

Internally, the shoe has a sole plate 22 which is pivotally mounted to sole 12 at the toe of the shoe. The sole plate 22 has an interior cavity 23, in which are disposed fluid conduits of the heat engine, described in greater detail hereafter.

As shown in FIG. 1, the sole plate 22 is urged upwardly by a resilient spring 26 having a lever arm which is biased upwardly by a torsion spring 60 which has a forward arm 74 that is also biased upwardly under the arch portion of the sole plate 22. Preferably, arm 26 bears against the undersurface of a plate 78 which is secured to the movable post 48 of the compressor 40. The compressor 40 is mounted in a cavity 34 in the heel of the shoe. If desired, another supplemental spring 67 can be provided at a forward portion of the sole 12. and a recess 65 cam be provided in the sole 12 to receive the spring 67.

Figure 2:
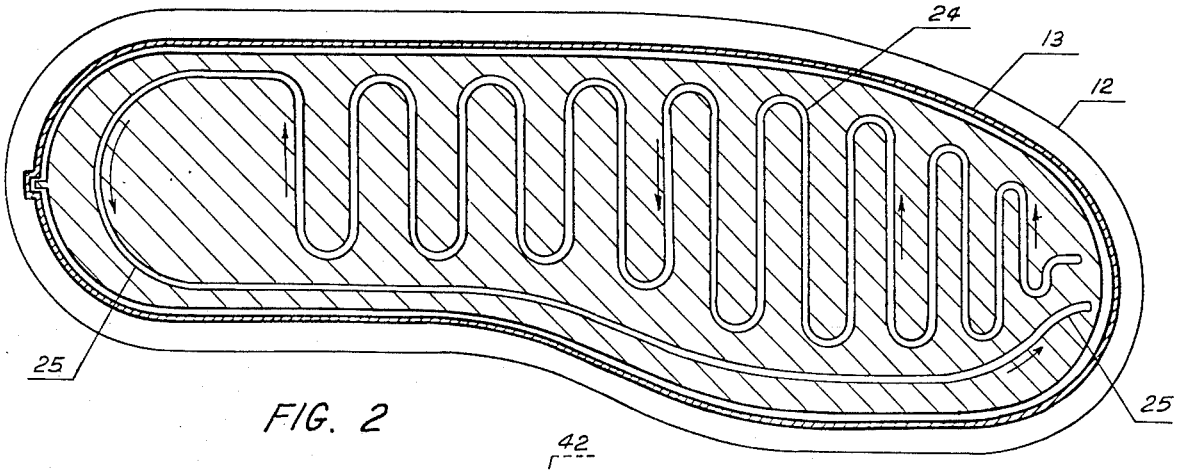
FIG. 2 is a view along line 2—2' of FIG. 1.

As shown in FIG. 2, the sole plate 22 is of a laminated construction with an interior cavity 23 which receives a coil 24 of the heat engine of the invention. Coil 24 can be disposed across the surface of the sole plate 22 in any manner, preferably in the form of a serpentine winding, traversing laterally in reverse directions along the length of the sole plate. The coil 24 also includes a return line 25 which extends to the toe of the sole plate and is connected beneath the sole plate to the communicating portions of the heat engine.

Figure 3:
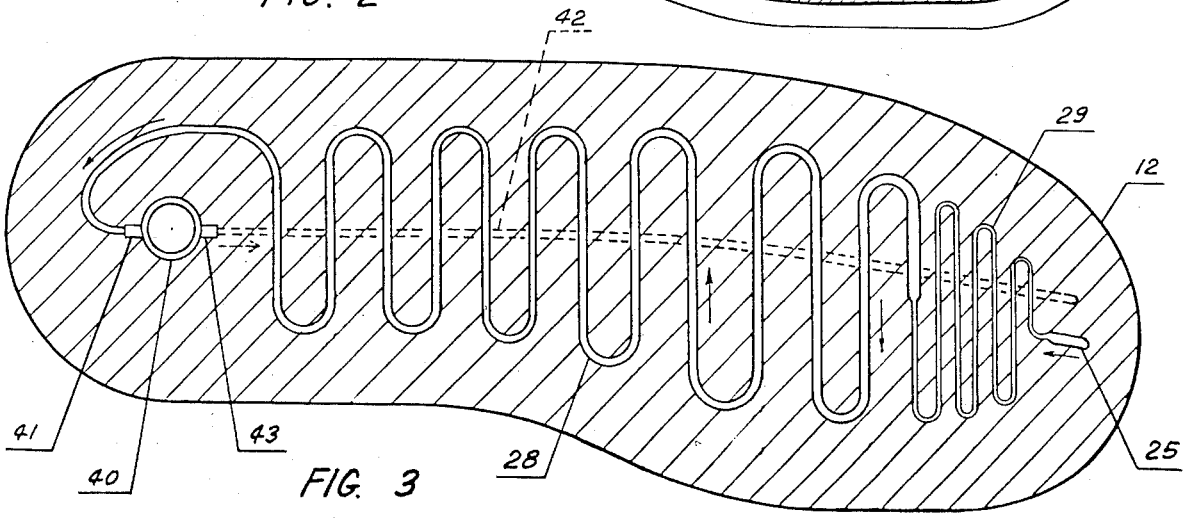
FIG. 3 is a view along line 3—3' of FIG. 1.

Referring again to FIG. 1, the external sole 12 of the shoe also has a central cavity 27 in which is disposed another coil 28. This coil is shown in FIG. 3 and also comprises a serpentine winding of a hollow coil across the surface of the external sole 12. The coil 28 is in open communication with a small diameter capillary coil 29 located in the toe portion of the external sole 12. The capillary tube functions as a flow restrictor and other elements such as an orifice or valve could also be used for this purpose. The capillary tube 29 is in open communication with the return conduit 25 illustrated in FIG. 2. The serpentine coil 28 in the external sole 12 discharges into compressor 40 of the heat engine of the invention, through a directional check valve 41. The compressor 40 discharges through a second check valve 43 into conduit 42 that extends to the toe of the external sole 12 where it passes upwardly into open communication with the coil 24 located in the internal sole plate 23.

Figure 4:
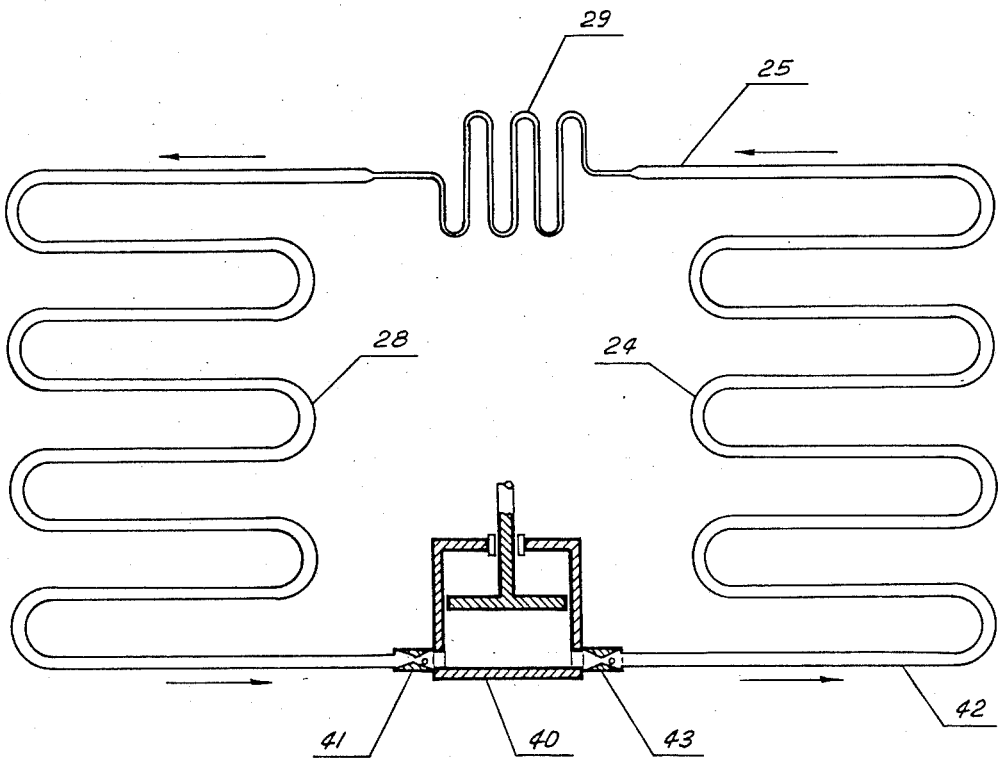
FIG. 4 is a diagrammatic view of the working elements of the heat engine used in the invention.

Referring now to FIG. 4, the heat engine of the invention will be briefly described. As there illustrated, the heat engine comprises a closed circulation system comprising compressor 40 with the aforementioned check valves 41 and 43. Conduit 42 discharges into the coil 24 and this coil discharges through conduit 25 into the capillary coil 29. The capillary coil 29 discharges into a second coil 28 which is in open communication with compressor 40 through valve 41.

Figure 5:
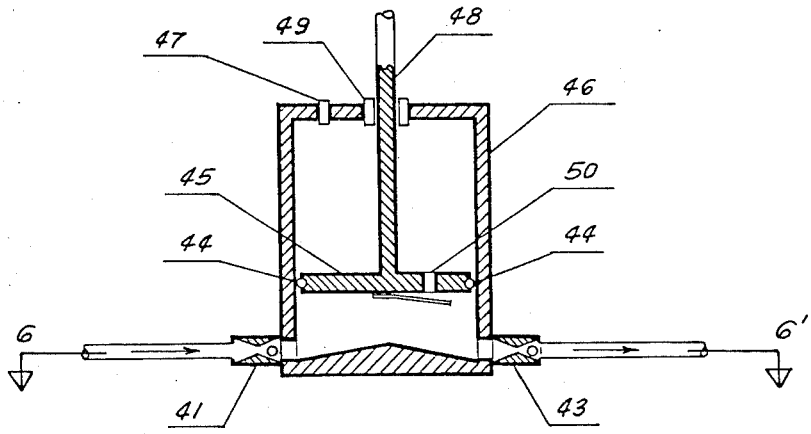
FIG. 5 is an elevational sectional view of a suitable compressor for use in the invention.
Figure 6:
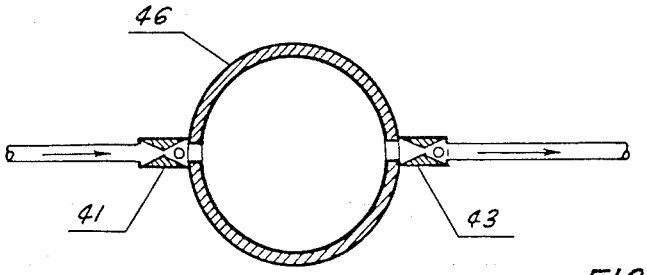
FIG. 6 is a sectional view along line 6—6' of FIG. 5.

The compressor 40 is illustrated in greater detail in FIG. 5 and includes a piston 45 that is mounted on the end of post 48 and reciprocally received in cylinder 46. Post 48 is received through a suitable packing gland 49 in cylinder 46. Piston 45 has a valve, such as a flapper valve 50. The cylinder 46 is also provided with the aforementioned check valves 41 and 43 which can be simple check valves such as flapper valves or spring biased ball valves.

The functioning of the heat engine is in accordance with conventional heat engine cycles. A suitable working fluid such as Freon, ammonia, etc., is circulated through the heat engine in a refrigeration/heating cycle. The working fluid is compressed by compressor 40 and is transferred through line 42 as a compressed, mixed liquid and gas phases. The working fluid, under compression from compressor 40 condenses into a liquid in the condenser section 24 releasing its latent heat of evaporation. The condensed working liquid thus releases its latent heat to the internal sole plate 22, warming the interior of the shoe. After passing through coil 24, the working fluid is transferred by line 25 to a capillary coil 29 where it expands as it undergoes a frictional pressure drop as it flows through this capillary coil 29. The frictional flow pressure drop is sufficient to reduce the pressure of the working fluid and cause evaporation of the liquid, forming a gas phase in the evaporator coil 28. As it evaporates, the working fluid absorbs heat from the surrounding area to provide the necessary latent heat of vaporization of the liquid. The heat is thus absorbed from the external sole 12, which is exposed to the elements. The evaporated gas is then transferred through check valve 41 into compressor 40 for continuous circulation in the system.

As can be seen from the preceding description, heat is liberated by the coil 24 and is absorbed by coil 28.

Referring now to FIG. 1, coil 24 is contained within the internal sole plate 22 of the shoe, where it is effective in liberating heat to the internal chamber of the shoe, thereby warming the foot and toes of the wearer. Heat is absorbed from the external sole 12 by coil 28. The external sole 12 preferably includes a thermally insulating layer 31 of suitable material, e.g., a closed cell foam, which thermally isolates the heating and cooling coils of the heat engine of the invention, and the immediately surrounding portions of the internal sole plate 22 and external sole 12.

Figure 11:
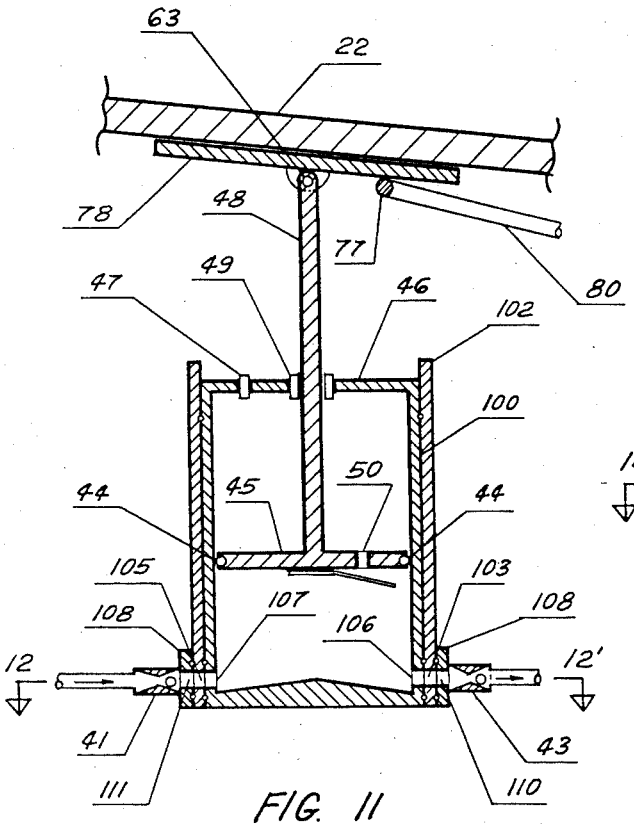
FIG. 11 is an elevational sectional view along lines 11—11' of FIG. 12 of an alternative compressor for use in the invention.

As shown in FIG. 1, the heel 32 has an interior cavity 34 which receives the compressor 40 of the heat engine. Cavity 34 lies beneath the heel portion of internal sole plate 22. Post 48 extends upwardly through sealed aperture 49 in the upper wall of the compressor and supports, at its upper end, a flat bearing plate 78 which bears against the undersurface of the heel portion of the internal sole plate 22. The upper surface of plate 78 can have a Teflon coating for low frictional contact with the undersurface of inner sole 22. The undersurface of plate 78 could also have a Teflon coating for low frictional contact with arm 77. In this manner, a downward pressure on the heel portion of internal sole plate 22 moves the post 48 downwardly, compressing fluid in the compressor 40. As shown in FIG. 11, post 48 is pivotally attached to the undersurface of plate 78 by pin 63 which extends through aligned apertures in the upper end of post 48 and a bracket on the undersurface of plate 78.

As shown in FIGS. 1 and 2, the internal sole plate 22 can have a central stiffening rib with a distal tab 52 that is received within channel 54 of wall 56 at the heel of the shoe.

Figure 7:
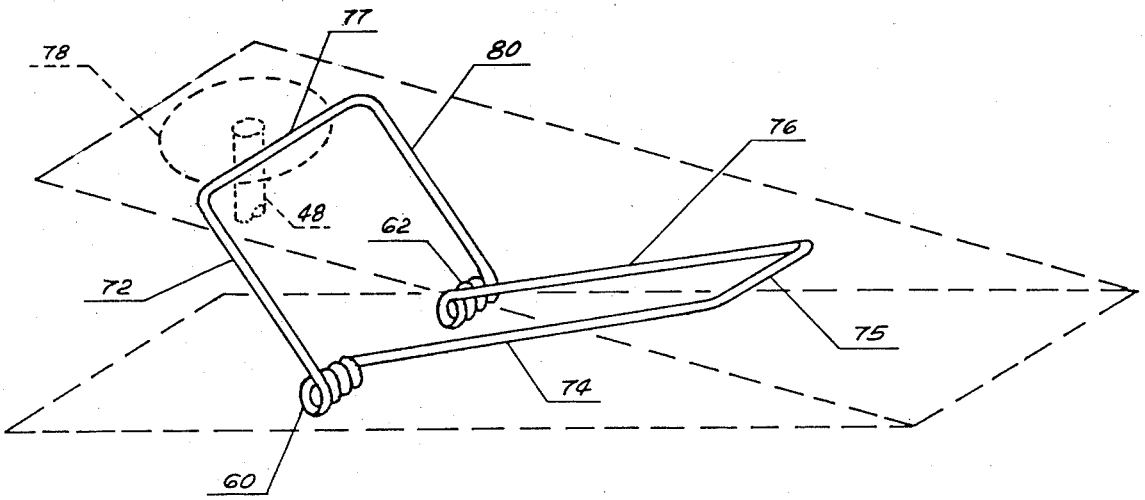
FIG. 7 is a perspective view of the spring used in the shoe.

Positive lift means for the internal sole plate 22 is provided by the resilient torsion spring 26 located beneath the internal sole plate 22. The plate 78 functions to link spring 60 to piston 45 for return and to protect against injury should the wearer jump downwardly on the heel. The spring is shown in FIG. 7, and includes a pair of torsion coils 60 and 62 which have forward arms 74 and 76 which are joined by lateral arm 75. The latter bears against the undersurface of the arch portion of internal sole plate 22. The spring also includes a pair of rear arms 72 and 80, with a crossbar 77. The upper ends of arms 72 and 80 and crossbar 77 are preferably received against the undersurface of plate 78 which bears against the heel portion of the internal sole plate 22.

Figure 8:
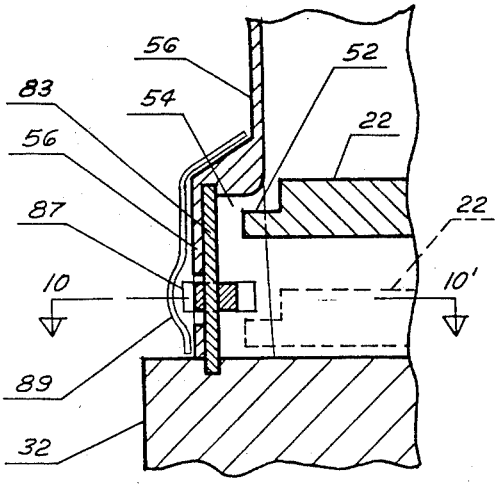
FIG. 8 is an enlarged elevational sectional view of the heel of the shoe.
Figure 9:
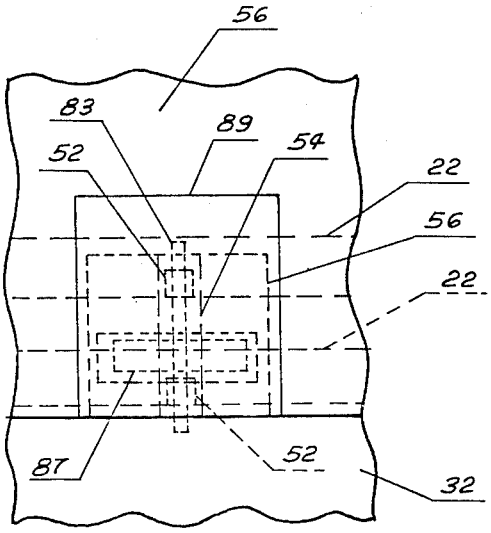
FIG. 9 is a rear elevational veiw of the heel of the shoe.
Figure 10:
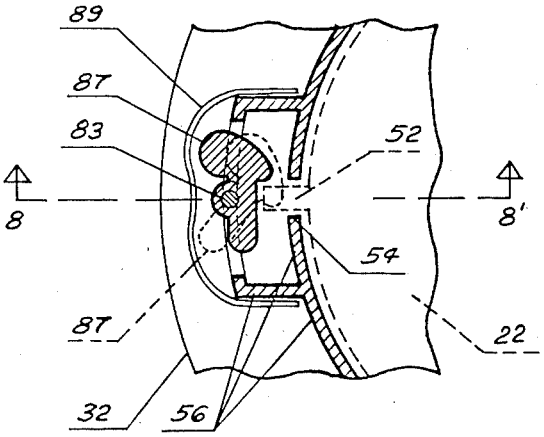
FIG. 10 is a view along line 10—10' of FIG. 9.

Referring now to FIGS. 8–10, the brake mechanism will now be described in greater detail. As previously mentioned, the inner sole plate 22 has a tab 52 which is received in a channel 54 in the rear wall 56 of the shoe. The rear wall 56 has a slot which receives a cam lever 87 that is pivotally mounted on shaft 83 (see FIG. 10). The cam lever 87 can thus be moved into an obstructing position, shown in phantom lines in FIG. 10, to restrain the inner sole in its depressed position, which is shown in phantom lines in FIG. 8. Preferably the entire mechanism is sealed by a protective covering 89 of rubber, leather or plastic, which can be cemented to the shoe.

Referring now to FIG. 11, there is illustrated an alternative compressor for use in the invention. The alternative compressor 100 is formed with an outer cylindrical casing 102 which receives the concentric cylinder 46. Cylinder 46 is similar to that previously described and includes an aperture in its top wall with a packing gland 49 that reciprocally receives post 48. Piston 45 is distally carried on post 48 for sliding movement within cylinder 46 and includes seal means such as O-ring 44 and valve 50, all previously described. The external cylindrical casing 102 has apertures 103 and 105 which can be aligned with the apertures 106 and 107 of cylinder 46. The apertures 103 and 105 are in communication with the flow check valves 41 and 43, respectively, of the heat engine, all previously described. In this illustrated embodiment, the check valves 41 and 43 are operable to control the fluid flow in the direction indicated by the arrowhead lines.

Figure 12:
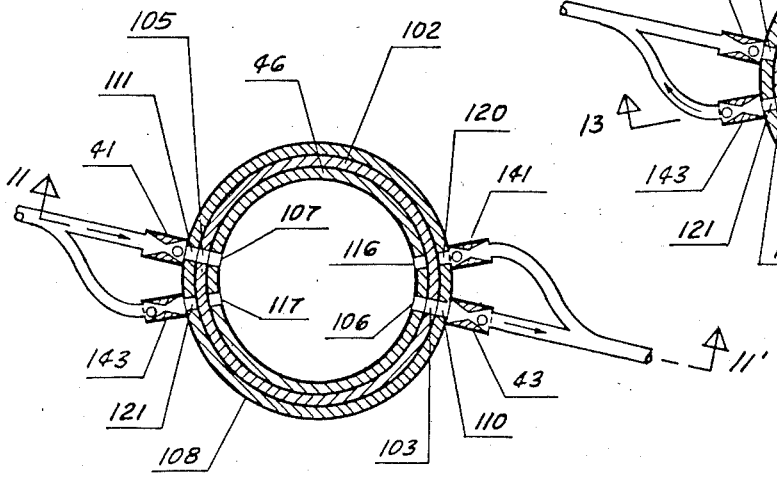
FIG. 12 is a view along 12—12' of FIG. 11.

The external casing 102 also supports, at its lower end, a sleeve 108 which has a first set of apertures 110 and 111 and a second set of angularly offset apertures 120 and 121; see also FIG. 12. Apertures 110 and 111 are in open communication with fluid check valves 41 and 43, previously described, while apertures 120 and 121 are in open communication with check valves 141 and 143, which are positioned in a reverse flow direction from check valves 41 and 43. In the illustrated configuration, the external casing 102 is rotated to align its single set of apertures 103 and 105 with apertures 110 and 111, which communicate with the check valves 41 and 43.

Figure 13:
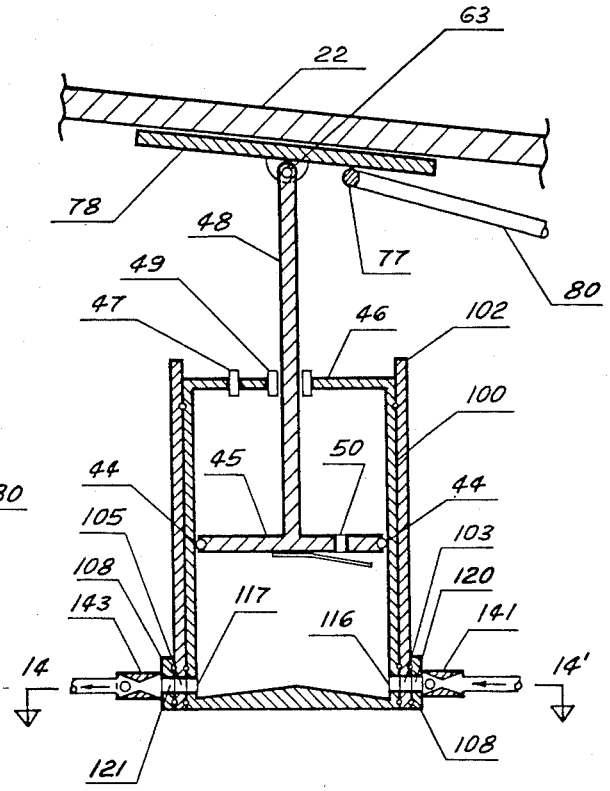
FIG. 13 is an elevational sectional view of the alternative compressor along lines 13—13' of FIG. 14 to reverse the cycle of the heat engine.
Figure 14:
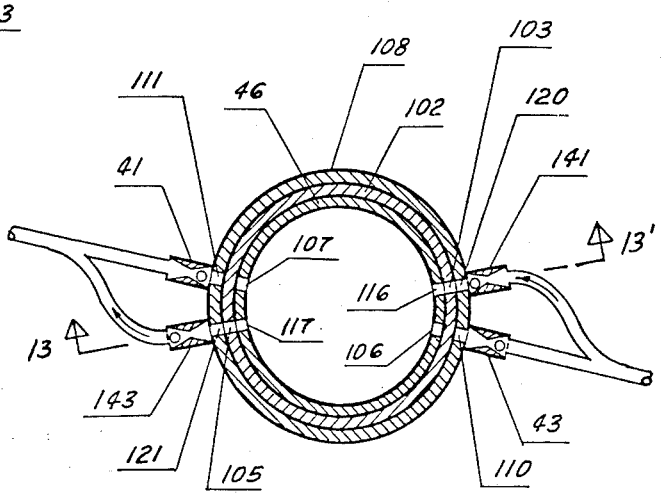
FIG. 14 is a view along 14—14' of FIG. 13.

Referring now to FIGS. 13 and 14, the external casing 102 has been rotated to align its apertures 103 and 105 with the apertures 120 and 121 of the sleeve 108, whereby the check valves 141 and 143 are effective to direct flow in the reverse direction, all as indicated by the arrowhead lines of FIG. 13.

In this manner, the embodiment of the compressor shown in FIGS. 11–14 is effective in reversing the operation of the heat engine in the shoe. This permits the shoe to be operated with a heating cycle for warming the wearer's foot and toes during cold weather applications with the coil 24 functioning as the condenser section of the heat engine. When the outer casing 102 is rotated to the position shown in FIGS. 13 and 14, however, the cycle is reversed and the coil 24 then functions as the evaporator portion of the heat engine. This absorbs heat from the interior cavity of the shoe, cooling the wearer's foot and toes during hot weather applications. In this manner, the mechanism can be used for warming or cooling the wearers foot at the discretion of the wearer. Access to the compressor can be obtained by lifting the lining 15 and raising the inner sole 22, to expose the compressor, and its outer casing 102.

Figure 15:
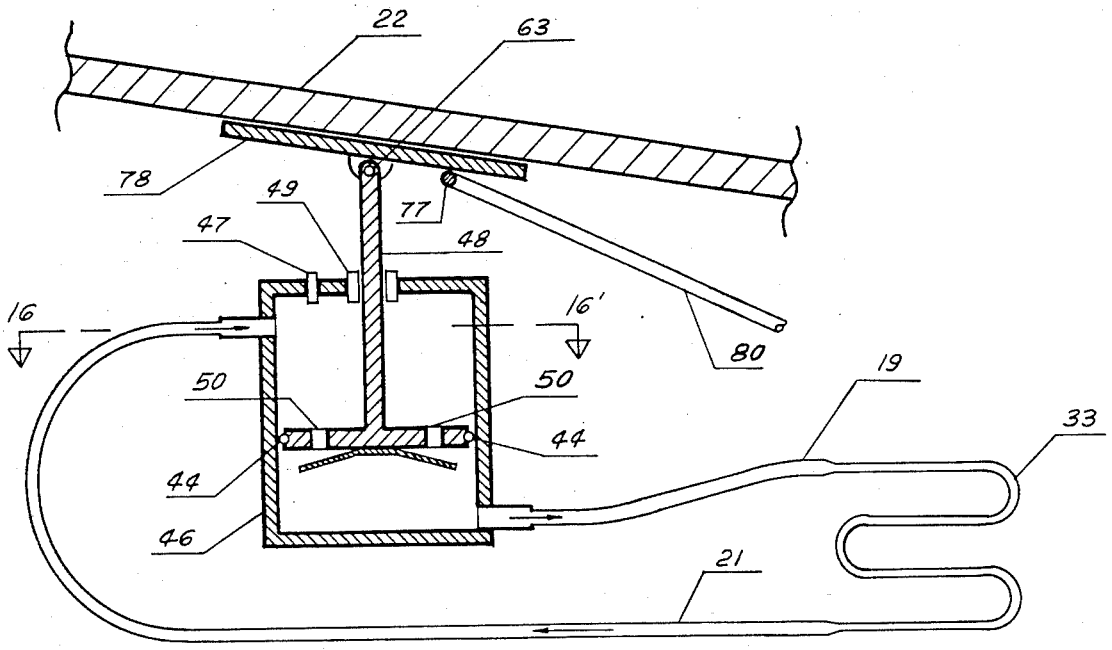
FIGS. 15 and 16 illustrate an alternative mechanism.
Figure 16:
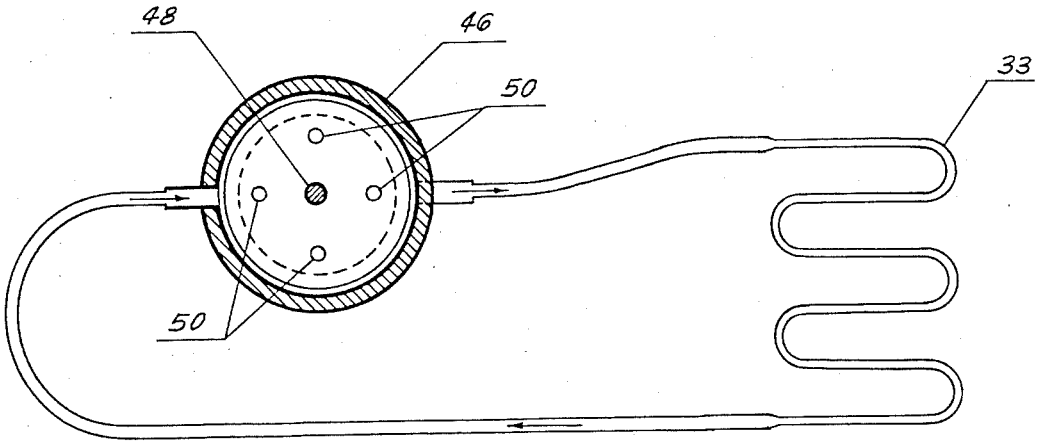

Referring now to FIGS. 15 and 16, the invention can also be applied to a simplified fluid circulation system. In this application, the piston 45, post 48, heel plate 78 and spring 80 are all as previously described. A working fluid, which can be Freon, is circulated through the capillary coil 33 under pressure during the downstroke of the piston 45. During this movement, the flapper valve on the undersurface of the piston will close the fluid apertures 50 in piston 45. When the wearer's weight is lifted from the heel, spring 80 moves the heel plate 78 upwardly, lifting the piston, and the fluid in the cylinder passes through apertures 50 to the chamber beneath the piston. This configuration thus avoids the necessity for the check valves such as 41 and 43 previously described. The capillary 33 functions to provide a high fluid pressure drop, thereby converting the line 19 into a heating unit, and line 21 into a cooling unit. These lines could be in the form of a serpentine coil winding such as coils 24 and 28, previously described.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A shoe with an internal foot warmer which includes:

a. an inner sole pivotally mounted at its toe end;

b. resilient lift means biasing the heel of said inner sole in an upward direction;

c. a heat engine operating on a Carnot cycle that includes:

(1) a closed circulation loop having first and second coils separated by a restrictor;

(2) a working fluid within said loop;

(3) a compressor for the working fluid;

d. mechanical means linking said heel of said inner sole to said compressor, whereby up and down movements of said heel are operative to compress said working fluid and circulate it through said closed loop releasing heat in said first coil and absorbing heat in said second coil.

2. The shoe of claim 1 wherein said second fluid coil is in the external sole of said shoe.

3. The shoe of claim 1 wherein said first fluid coil is in the inner sole of said shoe.

4. A shoe with an internal foot warmer which includes:

a. an inner sole pivotally mounted at its toe end;

b. resilient lift means biasing the heel of said inner sole in an upward direction;

c. a compressor;

d. mechanical link coupling said heel end of said inner sole to said compressor;

e. a working fluid within said compressor;

f. first and second fluid passageway coils interconnected by a fluid restrictor means and coupled to the inlet and discharge of said compressor, respectively; and g. including flow check valve means to control the fluid flow through said compressor.

5. The shoe of claim 4 wherein said second fluid passageway coil is in the external sole of said shoe.

6. The shoe of claim 4 wherein said first fluid passageway coil is in the inner sole of said shoe.

7. A shoe with an internal foot warmer comprising:

a. an inner sole pivotally mounted at its toe end;

b. resilient lift means biasing the heel of said inner sole in an upward direction;

c. a compressor located subjacent to the heel end of said inner sole and within the heel of said shoe;

d. a mechanical link coupling said heel end of said inner sole to said compressor;

e. a working fluid within said compressor;

f. first and second fluid passageway coils interconnected by a fluid restrictor means;

g. fluid conduit means connecting said first and second fluid passageway coils to the discharge, and intake, respectively, of said compressor;

h. with said first fluid passageway coil in heat transfer relationship to the interior of said shoe and with said second fluid passageway coil in heat transfer relationship to the exterior of said shoe.

8. The shoe of claim 7 wherein said second fluid passageway coil is in the external sole of said shoe.

9. The shoe of claim 7 wherein said first fluid passageway coil is in the inner sole of said shoe.

10. The shoe of claim 7 wherein said compressor has two sets of pairs of inlet and outlet check valves in reversed flow direction, and including means to switch said compressor inlet and outlet ports between said first and second sets of paired check valves, thereby reversing the heating and cooling cycles of said heat engine.

11. The shoe of claim 7 including brake means to restrain the movement of said inner sole.

12. The shoe of claim 11 wherein said brake means includes a cam lever pivotally mounted in the heel of the shoe.

13. The shoe of claim 12 wherein said cam lever is operative to move into a position obstructing the upward movement of said inner sole.

14. The shoe of claim 11 wherein said cam lever is covered with a protective rubber covering.

* * * * *

UNITED STATES PATENT AND TRADEMARK OFFICE

Certificate

Patent No. 4,736,530

Patented: Apr. 12, 1988

On petition requesting issuance of a certificate for correction of inventorship pursuant to 35 USC 256, it has been found that the above-identified patent, through error and without any deceptive intent, improperly sets forth the inventorship. Accordingly, it is hereby certified that the correct inventorship of this patent is:
Nikola Lakic Signed and Sealed this 26th Day of September 1989

Werner H. Schroeder
*Supervisory Patent Examiner*
*Patent Examing Art Group 247*